US007252063B2

(12) United States Patent
Mazuka et al.

(10) Patent No.: US 7,252,063 B2
(45) Date of Patent: Aug. 7, 2007

(54) ENGINE GENERATOR

(75) Inventors: Naoto Mazuka, Iwata (JP); Masanobu Yamamoto, Iwata (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/296,140

(22) Filed: Dec. 7, 2005

(65) Prior Publication Data

US 2006/0169238 A1 Aug. 3, 2006

(30) Foreign Application Priority Data

Dec. 7, 2004 (JP) ..... 2004-354689

(51) Int. Cl.
*F02B 63/04* (2006.01)
*F02M 1/02* (2006.01)

(52) U.S. Cl. ..... 123/179.18; 123/185.3; 290/1 A

(58) Field of Classification Search ..... 123/2, 123/179.18, 185.2, 185.3, 185.4, 198 DB, 123/198 E See application file for complete search history.

(56) References Cited

U.S. PATENT DOCUMENTS 4,907,546 A * 3/1990 Ishii et al. ..... 123/2

FOREIGN PATENT DOCUMENTS

JP 2002-309959 10/2002

OTHER PUBLICATIONS

JPO AIPN translation of JP 2002-309959 A, Suzuki et al, Oct. 23, 2002.*

* cited by examiner

*Primary Examiner*—Stephen K. Cronin
*Assistant Examiner*—Arnold Castro
(74) *Attorney, Agent, or Firm*—Knobbe, Martens, Olson & Bear LLP

(57) ABSTRACT

A front panel of an engine generator can have a recess including an upper area and a lower area, separated from each other by a partition. A cock operating portion and a choke operating portion can be laterally aligned with each other in the upper area, and a recoil knob can be located in the lower area. The front panel and the partition can be formed in one body of a resin material. An iron protective portion can be disposed around the partition.

5 Claims, 7 Drawing Sheets

ENGINE GENERATOR

PRIORITY INFORMATION

This application is based on and claims priority under 35 U.S.C. § 119 to Japanese Patent Application No. 2004-354689, filed on Dec. 7, 2004, the entire contents of which is hereby expressly incorporated by reference.

BACKGROUND OF THE INVENTIONS

1. Field of the Inventions

The present inventions relate to an engine generator, and more particularly, to engine-powered generators having recoil knobs, cock operating portions and choke operating portions.

2. Description of the Related Art

Engine-powered generators in which a generator is driven by an engine to generate power have long been used as portable electric power supplies. Some of such generators are started when the user operates various operating portions, switches and the like located on a control panel of the generator. Such generators can include operating portions and switches disposed on a certain part of the front panel. Other generators include a single operating portion used for several different operations. See, for example, Japanese Patent Publication No. JP-A-2002-309959.

A control panel included in the generator of JP-A-2002-309959 has a switch operating portion operable to select between an engine stop position, an engine operation position, and a choke position. The switch operating portion is connected to a switch shaft which rotates in connection with the switch operating portion.

The switch shaft is also connected to a cock operating portion for opening and closing a fuel cock, and a choke operating portion for opening and closing a choke. The switch shaft is also formed with a cam switch portion for turning on/off a stop switch for controlling power supply to an ignition device of the engine.

The cock operating portion closes the fuel cock when the switch operating portion selects the engine stop position, and opens the fuel cock to supply fuel to the engine when the switch operating portion selects the engine operation position and the choke position. Additionally, the choke operating portion opens the choke when the switch operating portion selects the engine stop position and the engine operation position, and closes the choke to increase the richness of the fuel when the switch operating portion selects the choke position.

The cam switch portion cuts off power supply to an ignition coil when the switch operating portion selects the engine stop position, and permits power supply to the ignition coil so that the engine is operable when the switch operating portion is in the engine operation position and when in the choke position. Thus, in this engine generator, operating the single switch permits opening and closing the fuel cock, the choke, and the enabling and disabling the ignition device.

SUMMARY OF THE INVENTIONS

An aspect of at least one of the embodiments disclosed herein includes the realization that, in the foregoing engine generator, although the multi-function knob is a space-efficient design, other problems can arise with respect to a recoil knob. For example, with the multi-function knob of JP-A-2002-309959, a recoil knob for a recoil starter is located below the control panel, away from the fuel cock operating portion and the choke operating portion. This results in a problem that the path for the recoil rope, which connects to the recoil starter, and the recoil knob becomes complex, and the recoil rope length increases. Additionally, the recoil know can strike the other controls as quickly returns to its stowed under the bias of a spring.

Thus, in accordance with at least one of the embodiments disclosed herein, an engine generator can comprise a front panel, an engine, a generator, and a fuel tank. The engine generator can also include a recoil knob for a recoil starter for starting the engine, a cock operating portion, and a choke operating portion. The recoil knob, the cock operating portion, and the choke operating portion can be located in a part of the front panel and adjacent to each other. The cock operating portion can be configured to open and close a fuel cock to permit and cut off supply of fuel from the fuel tank to the engine through a fuel passage. The choke operating portion can be configured to operating a choke device configured to regulate a richness of a fuel/air mixture supplied to the engine. The part of the front panel can be separated into first and second areas by a partition, the recoil knob being located in the first area, the cock operating portion and the choke operating portion being located in the second area.

BRIEF DESCRIPTION OF THE DRAWINGS

The above-mentioned and the other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

Figure 1:
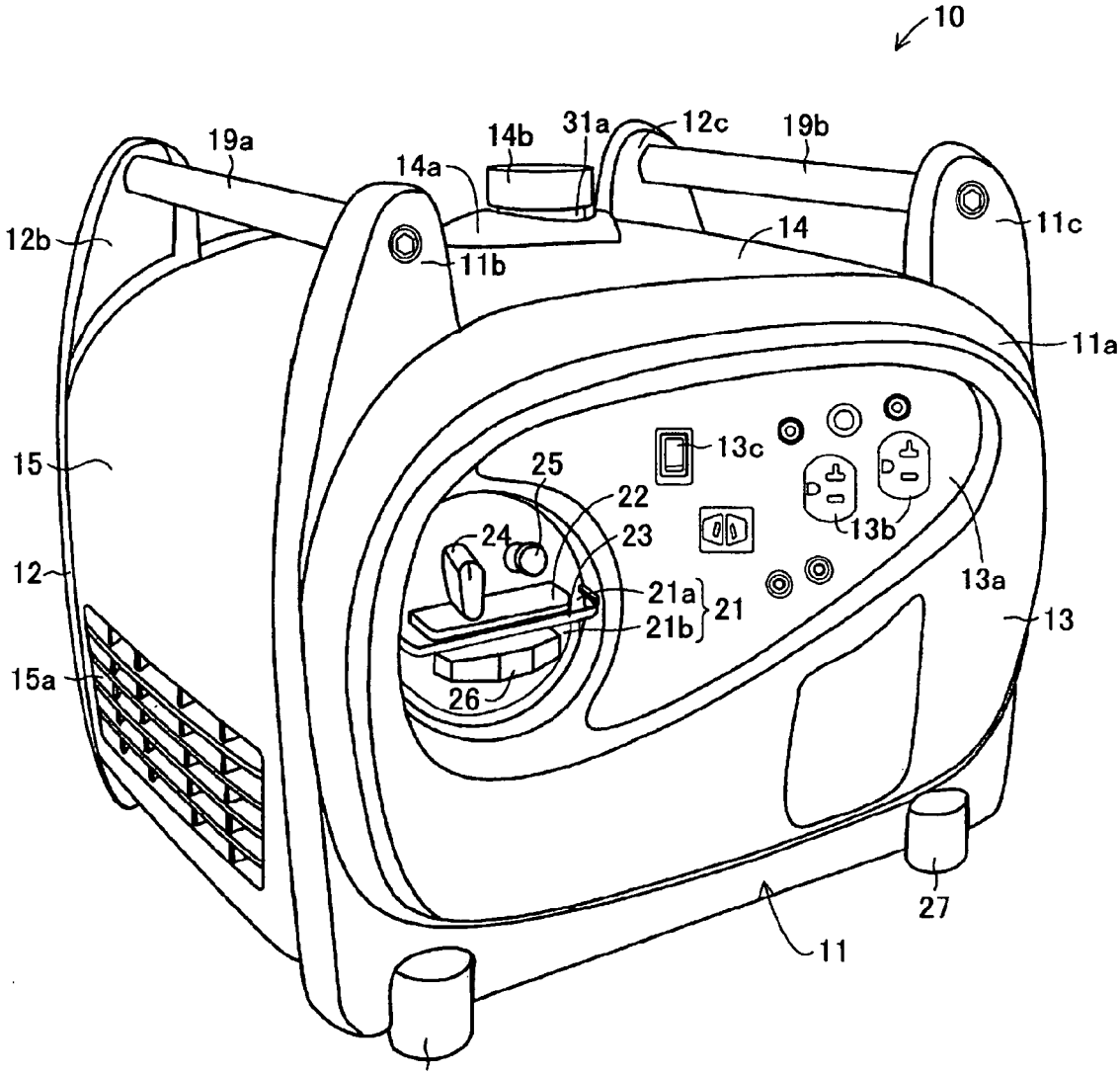
FIG. 1 is a perspective view of an engine generator in accordance with an embodiment.
Figure 2:
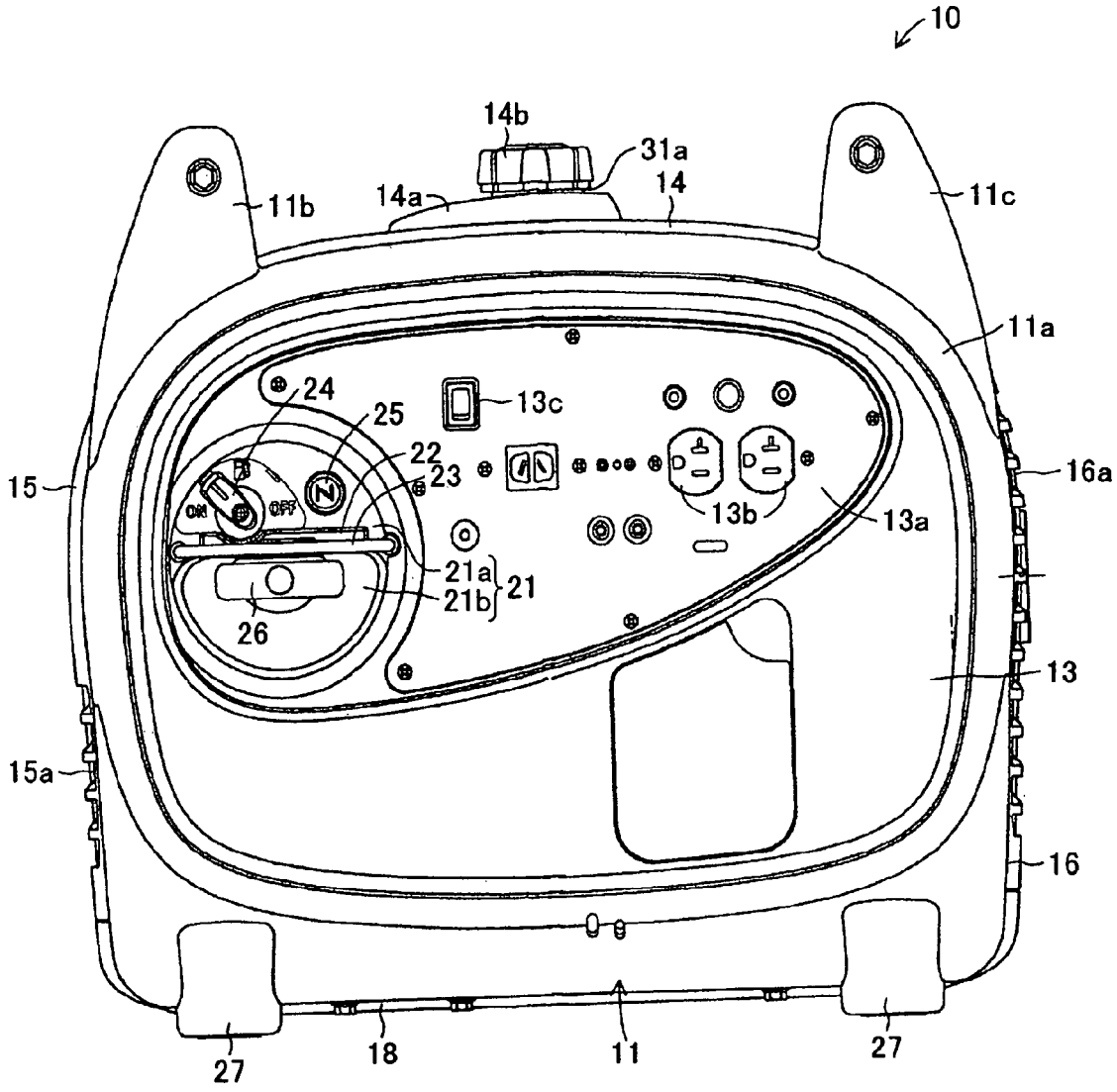
FIG. 2 is a front elevational view of the engine generator of FIG. 1.
Figure 3:
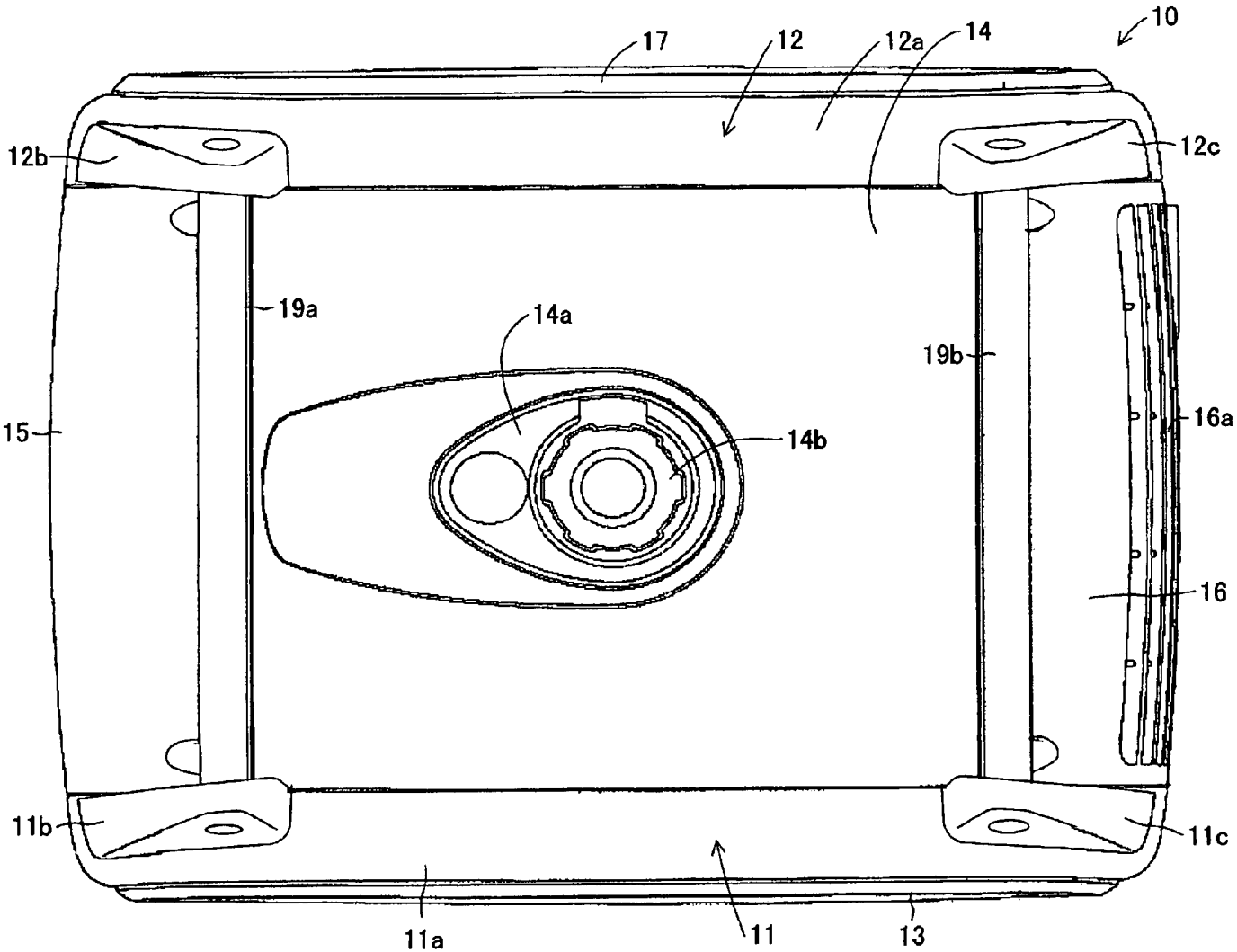
FIG. 3 is a top plan view of the engine generator of FIG. 1.
Figure 4:
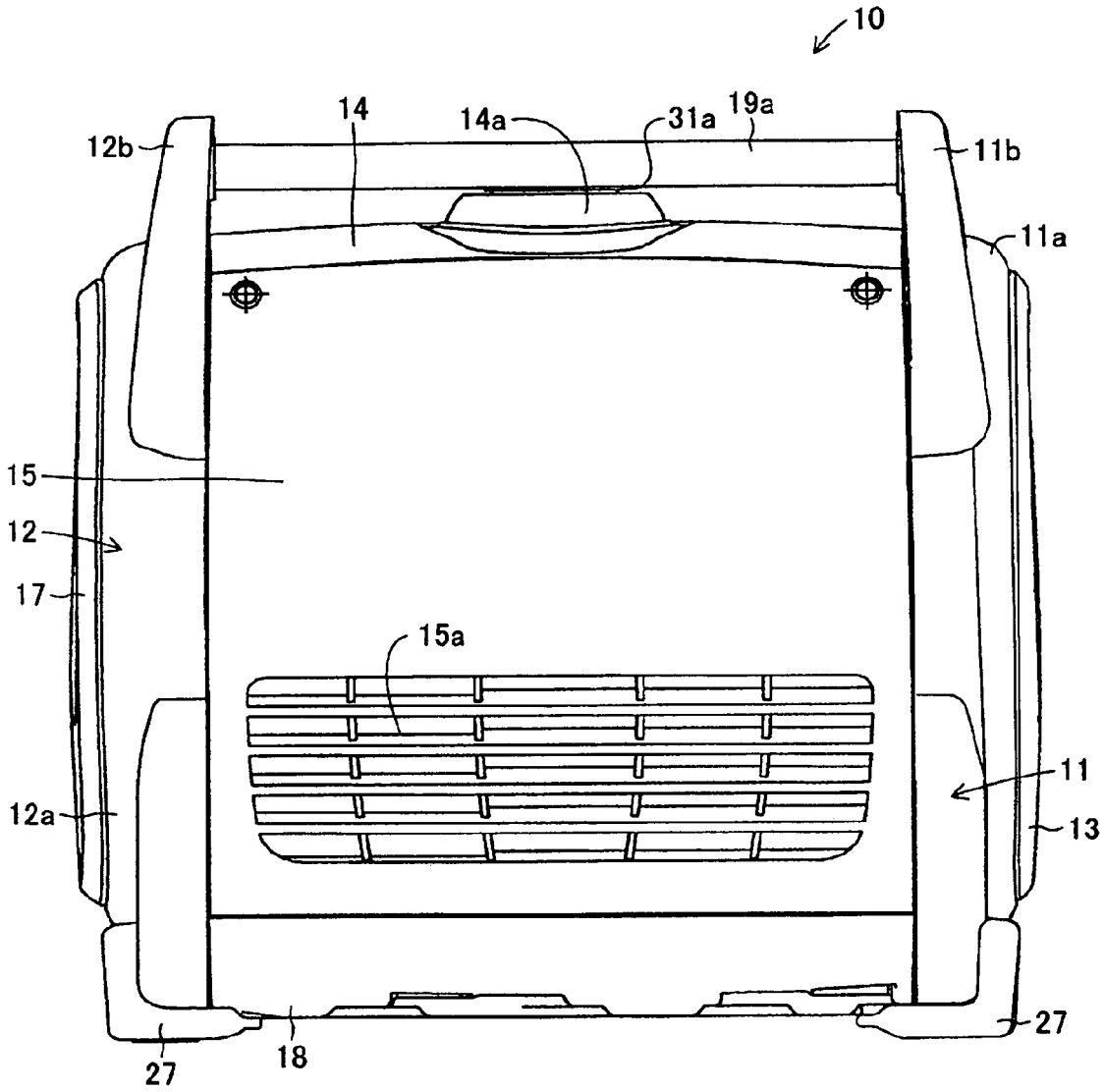
FIG. 4 is a left side elevational view of the engine generator of FIG. 1.
Figure 5:
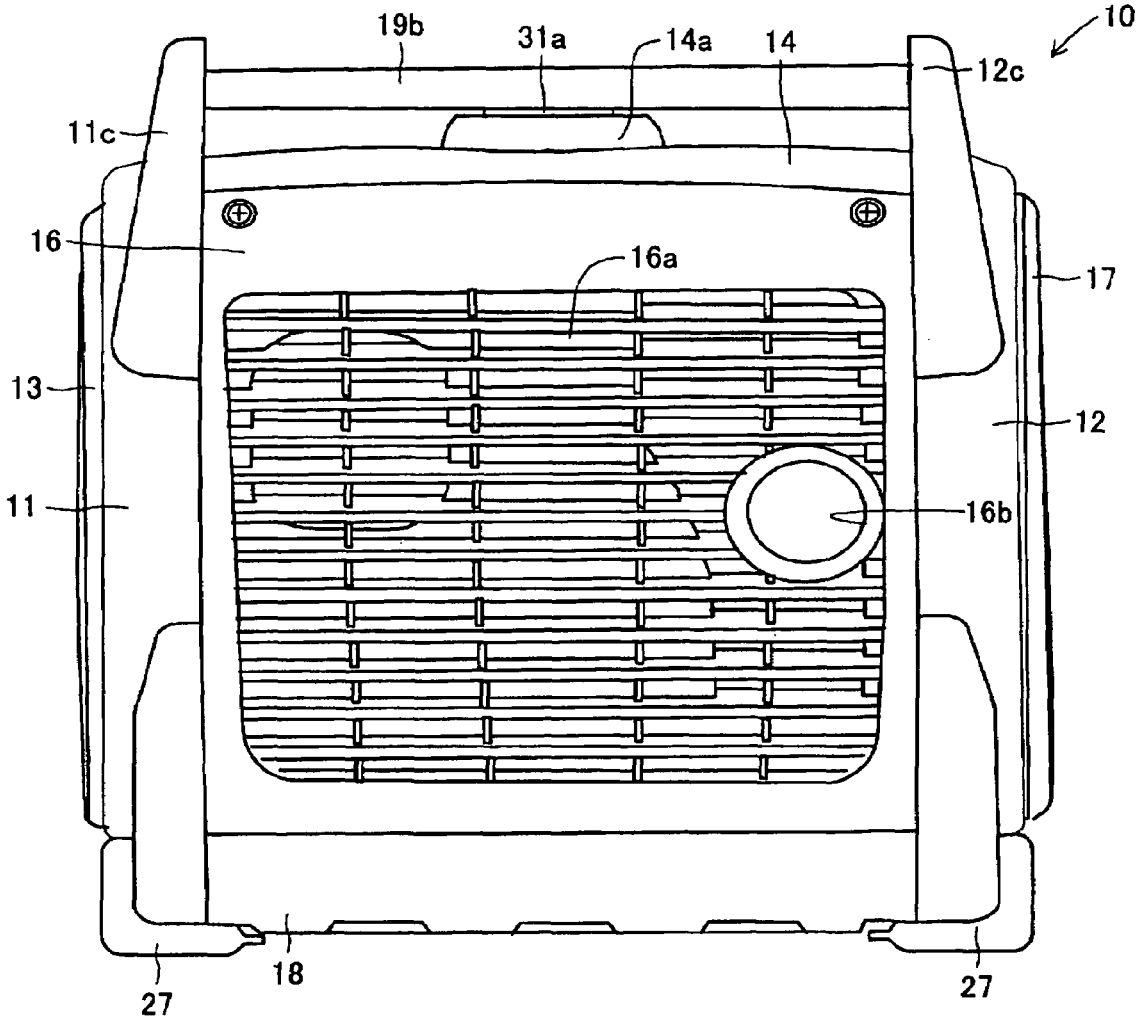
FIG. 5 is a right side elevational view of the engine generator of FIG. 1.

An engine generator 10 is described below with reference to drawings. The embodiments disclosed herein are described in the context of a small engine generator because the embodiments disclosed herein have particular utility in this context. However, the embodiments and inventions herein can also be applied to other engines or generators having other features than those disclosed herein. For example, but without limitation, the embodiments disclosed herein can also be applied to engines configured for stationary use, such as industrial engines, engines for pumps, air movers, etc.

With reference to FIGS. 1 through 5, the outer surface of the engine generator 10 is formed in a rounded, generally box-shape. The generator can include a pair of front and rear frames 11, 12 spaced apart from each other in the front-and-back direction, a front panel 13 and a rear panel 17. The rear panel 17 can be located within the front frame 11 and the rear frame 12, respectively. The engine generator 10 can also include a top panel 14,. an intake cover 15, an exhaust cover 16 and a bottom panel 18 located between the front frame 11 and the rear frame 12.

The front frame 11 and the rear frame 12 can have the same shape and can be made, in some embodiments, by aluminum die casting. The frames 11, 12, can include frame bodies 11*a*, 12*a*, respectively, formed in a generally square shape with both top sides having a round shape.

The top sides of the frame body 11*a* can be formed with a pair of projections 11*b*, 11*c* extending upwardly. Similarly, the top sides of the frame body 12*a* can be formed with a pair of projections 12*b*, 12*c* extending upwardly.

Bar-shaped handles 19*a*, 19*b* can be attached between the opposing projections 11*b*, 12*b* and 11*c*, 12*c*, respectively. The engine generator 10 can be carried by a person gripping this pair of handles 19*a*, 19*b*.

The front panel 13 can be attached within the front frame and can perform as a front portion of the engine generator 10. The front panel 13 can be formed from a resin material, as an integral component.

The front panel 13 can be formed in a generally square shape with rounded comers. An upper portion of the front panel 13 can be formed with a recess 13*a* of a generally oval shape having a large vertical width at its left portion (left-hand side as seen from the front side shown in FIGS. 1 and 2) and a small vertical width at its right portion. A circular recess 21 can be formed in the left portion of the recess 13*a*. There can be provided outlets 13*b*, various switches 13*c*, and the like in the portion other than the recess 21 of the recess 13*a*.

Figure 6:
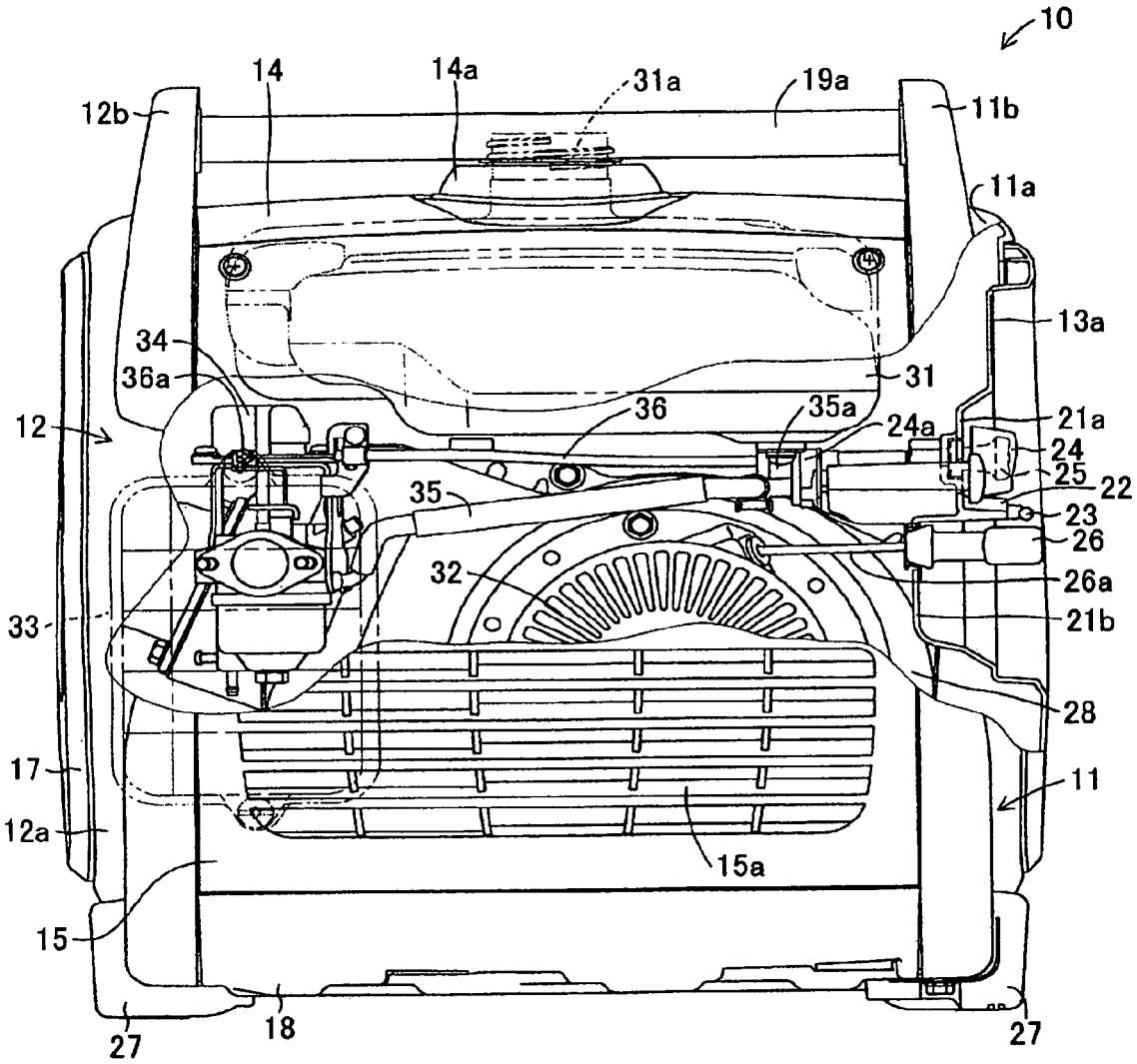
FIG. 6 is a partially cutaway and left side elevational view of the engine generator of FIG. 1, showing some of the internal components.

The recess 21 can be separated into an upper portion and a lower portion by a partition 22 which can be generally horizontally oriented and can include a plate-like wall member projecting toward the front side. A protective portion 23, which can be in the form of an iron bar, can be provided in a manner to enclose the front face and the opposite faces of the partition 22. However, other types of protective portions can also be used. As shown in FIG. 6, an upper area 21*a* comprising the upper portion of the recess 21 can have a smaller (shallower) depth than a lower area 21*b* which comprises the lower portion of the recess 21.

The upper area 21*a* of a smaller depth can have a cock operating portion 24 and a choke operating portion 25 generally laterally aligned with each other, although other configurations can also be used. The lower area 21*b* of a larger depth can have a recoil knob 26. The cock operating portion 24, choke operating portion 25 and recoil knob 26 can be disposed such that they do not project outwardly from the surface of the peripheral edge of the front panel 13. This provides enhanced protection of these knobs and portions.

The partition 22 can be formed with the front panel 13 in one body, and the protective portion 23 can be fixed to the front panel 13 with the ends of the protective portion 23 inserted in the front panel 13. However, other constructions can also be used.

The top panel 14 provides a top portion of the engine generator 10. In some embodiments, the top panel 14 can be attached between the opposing upper edges of the front frame 11 and the rear frame 12.

The top panel 14 can be formed in the shape of a curved surface and can extend laterally with its central portion curved upwardly. The generally central portion of the top panel 14 can be formed with a fuel filling portion 14*a* which can project upwardly for accommodating the introduction of fuel into fuel supply port 31*a* of a fuel tank 31, described in greater detail below. A tank cap 14*b* can be attached to the fuel supply port 31*a*.

The intake cover 15 and the exhaust cover 16 can be attached between the opposing side edges of the front frame 11 and the rear frame 12 and thus can provide side portions of the engine generator 10. A lower portion of the intake cover 15 can be formed with a plurality of lateral intake slits 15*a* vertically aligned with each other. The exhaust cover 16 at the surface of its large central portion can also be formed with a plurality of lateral exhaust slits 16*a* vertically aligned with each other. A circular exhaust hole 16*b* can also be formed in a vertically generally central portion on the rear side of the exhaust cover 16.

The rear panel 17 can be attached within the rear frame 12 and thus can provide a rear portion of the engine generator. 10. The overall shape of the rear panel 17 can be generally the same as that of the front panel 13. However, in some embodiments, the rear panel 17 can be formed with no recesses or the like.

The bottom panel 18 can be attached between the opposing lower edges of the front frame 11 and the rear frame 12 and thus can provide a bottom portion of the engine generator 10. The left and right edges of the bottom panel 18 can be slightly, raised from the opposite sides of the bottom surface and extend upwardly, and configure lower portions of the corresponding side portions of the engine generator 10.

The top panel 14, intake cover 15, exhaust cover 16, rear panel 17 and bottom panel 18 can each be integrally formed from a resin material, however, other constructions and materials can also be used. The opposite lower side edges of the front frame 11 and the rear frame 12 can each be provided with a rubber leg 27. There can be interposed a frame made of a metal sheet (not shown) between the front frame 11 and the rear frame 12 to securely connect these frames, which forms a frame portion. However, other configurations can also be used.

Figure 7:
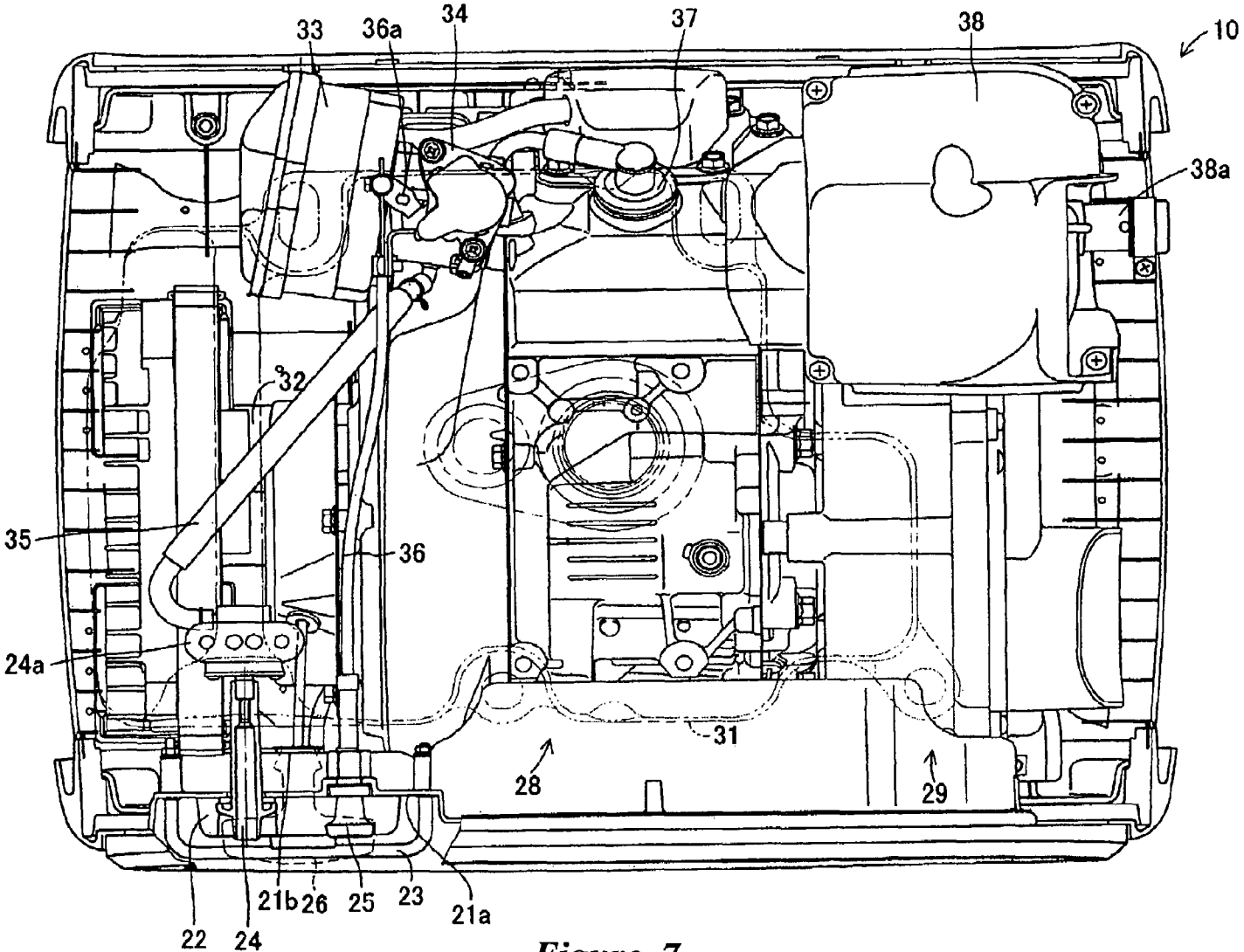
FIG. 7 is a partial cutaway and top plan view of the engine generator of FIG. 1.

FIGS. 6 and 7 show the inside of the engine generator 10. A lower portion of the inside of the engine generator 10 has an engine 28 and a generator 29 aligned with each other, and the fuel tank 31 can be located above the engine 28 and the generator 29, however, other arrangements can also be used.

The foregoing fuel supply port 31*a* can be formed in a top central portion of the fuel tank 31, and can extend through the fuel supply portion inserting portion 14*a* and can also project upwardly from the top panel 14. The removable tank cap 14*b* can be attached to the fuel supply port 31*a*. There can be mounted an intake fan portion 32 for drawing ambient air at a portion inside the engine generator 10 on the intake cover 15 side.

An air cleaner 33 can be located at a generally vertically central portion inside the engine generator 10 on its rear left side, however, other configurations can also be used. A carburetor 34 can be located adjacent to the air cleaner 33 and closer to the central portion of the engine generator 10 than the air cleaner 33. The air cleaner 33 can be positioned on the intake side of the engine 28, and can be configured to introduce and purify (or filter) the ambient air drawn by the intake fan portion 32 and then feed the air to the carburetor 34.

The carburetor 34 can be connected to one end of a fuel pipe 35 and one end of a choke cable 36. The other end of the fuel pipe 35 can be connected to a fuel cock 24*a* which is connected to the cock operating portion 24. The fuel cock 24*a* can also be connected to a fuel pipe 35*a* which is connected to the fuel tank 31.

Thus, when the user operates the cock operating portion 24 to open the fuel cock 24*a*, fuel in the fuel tank 31 can be supplied to the carburetor 34. When the fuel cock 24*a* is closed, fuel supply from the fuel tank 31 to the carburetor 34 is stopped.

The fuel supplied from the fuel tank 31 to the carburetor 34 can be mixed with the air supplied from the air cleaner 33 to the carburetor 34 into a fuel/air mixture, which is then supplied to the engine 28 through an intake passage (not shown). The other end of the choke cable 36 can be connected to the choke operating portion 25. When the user operates the choke operating portion 25, a choke lever 36*a* between the one end of the choke cable 36 and the carburetor 34 can be moved so that the richness of the mixture is regulated.

Regulating the richness of the mixture can be accomplished by, for example, pulling the choke operating portion 25 so that the volume of air supplied from the air cleaner 33 to the carburetor 34 is decreased, and thus the richness of fuel can be increased.

The recoil knob 26 can be connected to a recoil starter (not shown) adjoining the engine 28, via a recoil rope 26*a*. The recoil starter can be connected to a crankshaft (not shown) of the engine 28. Thus, pulling the recoil knob 26 causes the recoil starter to rotate the crankshaft to start the engine 28.

The engine 28 can be provided with a spark plug 37. A muffler 38 can be disposed on the exhaust side of the engine 28 (a rear portion of the engine generator 10 on the exhaust cover 16 side). The spark plug 37 can be configured to ignite the fuel/air mixture fed from the carburetor 34 to thereby combust in the engine 28 and thereby rotate the crankshaft. Exhaust gas discharged from the engine 28 can be guided to the muffler 38 and released to the outside atmosphere from an exhaust pipe 38*a*.

The generator 29 can have a rotor shaft (not shown) connected to the crankshaft of the engine 28. As such, the generator 29 can generate power as the crankshaft of the engine 28 rotates the rotor shaft. For example, plural magnets can be mounted to the outer periphery of the rotor shaft, and a stator having a core with a coil wound thereon is located around the outer periphery of the magnets. When the magnets rotate inside the stator in connection with the crankshaft, an electromotive force is produced in the coil, so that power is generated. However, the generator 29 can also have other configurations.

In this configuration, to start the engine generator 10, the user can operate the cock operating portion 24 to open (turn on) the fuel cock so that the fuel in the fuel tank 31 can be supplied to the carburetor 34. Then, the user pulls the choke operating portion 25 adjoining the cock operating portion 24 to decrease the volume of air supplied from the air cleaner 33 to the carburetor 34 so that the richness of the fuel fed to the engine 28 is increased. This makes it easier to start the engine 28. In such state, the user pulls the recoil knob 26 to start the engine 28. In this case, the user should pull the recoil knob 26*a* obliquely upwardly toward the front side, with the recoil rope 26*a* being in contact with the lower surface of the protective portion 23.

This allows easy operation of the recoil knob 26. Further, after the engine 28 has been started, when the user releases the recoil knob 26 and the recoil knob 26 swiftly returns toward the front panel 13, the recoil knob 26 can be prevented from hitting the cock operating portion 24 and the choke operating portion 25 by the partition 22 and the protective portion 23. In this case, since the lower area 21*b* at which the recoil knob 26 is located is larger in depth than the upper area 21*a* and the other portions of the front panel 13, such contact-prevention effect is increased. Then, when the engine 28 has been warmed up, the choke operating portion 25 can be returned to its original position so that the richness of the fuel supplied to the engine 28 can be optimized for regular operation of the engine 28. Then, power generated by the engine generator, 10 can be used in other equipment by plugging a cord in the outlet 13*b*.

As described above, in the engine generator 10 in accordance with some embodiments, the cock operating portion 24, choke operating portion 25 and recoil knob 26 operable by the user for starting the engine 28, are located in the recess 21, which can be disposed in a part of the recess 13*a* disposed in the front panel 13. The recess 21 can be separated into the upper area 21*a* of a smaller depth and the lower area 21*b* of a larger depth. Additionally, the partition 22 can be disposed between the upper area 21*a* and the lower area 21*b*. Also, the upper area 21*a* has the cock operating portion 24 and the choke operating portion 25 laterally aligned with each other, and the lower area 21*b* has the recoil knob 26.

Thus, since the cock operating portion 24, choke operating portion 25 and recoil knob 26 are collected in one part, these components are easily operable. Also, the cock operating portion 24, choke operating portion 25 and all the other portions of the front panel 13 are prevented from being damaged by the recoil knob 26 when it springs back into place. Further, the recoil knob 26, cock operating portion 24 and choke operating portion 25 are prevented from being damaged by hitting surrounding objects. Further, since the protective portion 23 can be configured by bending an iron bar, little wear occurs on the protective portion 23 if it is rubbed by the recoil rope 26*a* when the user pulls the recoil knob 26.

With the protective portion 23 disposed around the partition 22, the user cannot grip the protective portion 23 by hand. This eliminates the chance of the user inadvertently gripping the protective portion 23 to pick up the engine generator 10. Therefore, damage to the protective portion 23 caused by application of force can be prevented. Further, in the foregoing engine generator 10, such a layout is allowed that the recoil rope 26*a*, fuel pipe 35 and choke cable 36 do not interfere with each other inside the engine generator 10. Also, the cock operating portion 24, choke operating portion 25 and recoil knob 26 can be located in a more optimal manner for the internal structure of the engine generator 10.

The present inventions are not limited to the embodiments described above and can be practiced with appropriate modifications. For example, in some of the foregoing embodiments, there are provided the partition 22 and the protective portion 23. However, the protective portion 23 can be used also as the partition without the partition 22. In this case, the protective portion 23 may include not the enclosing-shaped iron bar but a plate-like wall member. Additionally, a metal plate member may be embedded in the partition 22, and in this case, preferably, the top edge of the plate member projects from the partition.

Further, in some of the foregoing embodiments, the recess 21 can be separated into the upper area 21*a* and the lower area 21*b*, and the cock operating portion 24 and the choke operating portion 25 are located in the upper area 21*a* and the recoil knob 26 can be located in the lower area 21*b*. However, this arrangement can be modified as appropriate. For example, the recess 21 may be separated into left and right portions, in which the cock operating portion 24 and the choke operating portion 25 are located in the right portion and the recoil knob 26 is located in the left portion.

Alternatively, the recess 21 can be separated diagonally into two portions. Further, the rest of the configurations, materials and the like of the engine generator can be modified as appropriate within the technical scope of the present invention.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious, modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An engine generator comprising a front panel, an engine, a generator, a fuel tank, a recoil knob for a recoil starter for starting the engine, a cock operating portion, and a choke operating portion, the recoil knob, the cock operating portion, and the choke operating portion being located in a part of the front panel and adjacent to each other, the cock operating portion being configured to open and close a fuel cock to permit and cut off supply of fuel from the fuel tank to the engine through a fuel passage, the choke operating portion being configured to operating a choke device configured to regulate a richness of a fuel/air mixture supplied to the engine, and wherein the part of the front panel is separated into first and second areas by a partition, the recoil knob being located in the first area, the cock operating portion and the choke operating portion being located in the second area, wherein the front panel is made from a resin material, and a metal protective portion is disposed around the partition.

2. The engine generator according to claim 1, wherein the partition is formed integrally with the front panel, and the protective portion encloses the periphery of the partition.

3. The engine generator according to claim 1, wherein the partition separates the part of the front panel into an upper and a lower area, the cock operating portion and the choke operating portion being laterally aligned with each other in the upper area and the recoil knob being located in the lower area.

4. An engine generator comprising a front panel, an engine, a generator, a fuel tank, a recoil knob for a recoil starter for starting the engine, a cock operating portion, and a choke operating portion, the recoil knob, the cock operating portion, and the choke operating portion being located in a part of the front panel and adjacent to each other, the cock operating portion being configured to open and close a fuel cock to permit and cut off supply of fuel from the fuel tank to the engine through a fuel passage, the choke operating portion being configured to operating a choke device configured to regulate a richness of a fuel/air mixture supplied to the engine, and wherein the part of the front panel is separated into first and second areas by a partition, the recoil knob being located in the first area, the cock operating portion and the choke operating portion being located in the second area, wherein the part of the front panel is configured as a recess, the partition including a wall member projecting from the front panel, wherein the front panel is made from a resin material, and a metal protective portion is disposed around the partition.

5. An engine generator comprising a front panel, an engine, a generator, a fuel tank, a recoil knob for a recoil starter for starting the engine, a cock operating portion, and a choke operating portion, the recoil knob, the cock operating portion, and the choke operating portion being located in a part of the front panel and adjacent to each other, the cock operating portion being configured to open and close a fuel cock to permit and cut off supply of fuel from the fuel tank to the engine through a fuel passage, the choke operating portion being configured to operating a choke device configured to regulate a richness of a fuel/air mixture supplied to the engine, and wherein the part of the front panel is separated into first and second areas by a partition, the recoil knob being located in the first area, the cock operating portion and the choke operating portion being located in the second area, wherein the cock operating portion and the choke operating portion are laterally or vertically aligned with each other, wherein the front panel is made from a resin material, and a metal protective portion is disposed around the partition.

* * * * *

UNITED STATES PATENT AND TRADEMARK OFFICE

CERTIFICATE OF CORRECTION

PATENT NO. : 7,252,063 B2
APPLICATION NO. : 11/296140
DATED : August 7, 2007
INVENTOR(S) : Mazuka et al.

It is certified that error appears in the above-identified patent and that said Letters Patent is hereby corrected as shown below:

At column 3, line 4, please delete "14,." and insert -- 14, --, therefor.

At column 3, line 21, before "and" please insert -- 11 --.

At column 3, line 25, please delete "comers." and insert -- corners. --, therefor.

At column 4, line 16, please delete "generator." and insert -- generator --, therefor.

At column 4, line 25, please delete "slightly," and insert -- slightly --, therefor.

At column 6, line 7, please delete "generator," and insert -- generator --, therefor.

Signed and Sealed this

Eighteenth Day of November, 2008

JON W. DUDAS
*Director of the United States Patent and Trademark Office*